US006093018A

United States Patent [19]

Avshalumov

[11] Patent Number: 6,093,018

[45] Date of Patent: Jul. 25, 2000

[54] GAS BURNER

[76] Inventor: Simon Avshalumov, 7 Michael Street, Khayfa, Israel

[21] Appl. No.: 08/928,087

[22] Filed: Sep. 12, 1997

[51] Int. Cl.[7] ..... F23D 14/14

[52] U.S. Cl. ..... 431/352; 431/353; 126/39 E

[58] Field of Search ..... 431/352, 351, 431/350, 195, 10, 353, 354; 126/214 R, 215, 214 D, 39 R, 39 E, 92 R, 92 AC, 39 D

[56] References Cited

U.S. PATENT DOCUMENTS

| | | | |
|---|---|---|---|
| 698,507 | 4/1902 | Jeha | 126/512 |
| 983,413 | 2/1911 | Swafford | 126/214 D |
| 997,278 | 7/1911 | Donnelly | 126/214 R |
| 1,129,546 | 2/1915 | Brettelle . | |
| 1,194,050 | 8/1916 | Martin | 126/214 R |
| 1,273,284 | 7/1918 | Smith | 431/352 |
| 1,546,919 | 7/1925 | Dore | 126/214 D |
| 2,001,972 | 5/1935 | McFall . | |
| 2,675,868 | 4/1954 | Ray | 431/352 |

FOREIGN PATENT DOCUMENTS

| | | | |
|---|---|---|---|
| 0072941 | 4/1986 | Japan | 126/39 K |

*Primary Examiner*—Carl D. Price
*Attorney, Agent, or Firm*—Zoya V. Chernina

[57] ABSTRACT

An improved gas burner comprising in combination means for controlled feeding and subsequent admixing of a secondary air directly to the base of the flame in a form of a cap coaxially surrounding a burner head of the gas burner comprising a lateral apertures for issuing combustible air-gas mixture to form a flame. The through lateral openings of the predetermined size having the total cross section greater than the total cross-section of the apertures of burner head are performed on the side wall surface of the cap. During the operation of the gas burner the exact measured amount of the secondary air is admixed directly to the base of the flame, thereby highly efficient and complete combustion process characterized by high-elevated temperature is achieved.

11 Claims, 4 Drawing Sheets

GAS BURNER

FIELD OF THE INVENTION

The invention relates to gas burners, including domestic appliances such as stove and aimed at providing the gas burners of the type that allow significantly to increase the coefficient of efficiency and method of operating such gas burners.

SUMMARY AND BACKGROUND OF THE INVENTION

The domestic gas burners of known design include means for forming and subsequent introducing a mixture of a supplied combustion gas and a primary air under the pressure and a burner head having an inlet port and a chamber for receiving the mixture. The head is provided with lateral apertures through wich the combustible mixture is issued to spread around the head and ignitor, such as a pilot light. A flame is ignited upon contacting of the combustible mixture with a pilot light.

A major deficiency of such burners is that during the gas burner's use an uncontrolled and excessive overdraft of the secondary air to the entire surface of the flame from surrounding atmosphere occurs. Thereat, efficiency of process of gas combustion decreases caused by the fact that only small part of the gas is mixed with air and the larger part thereof is wasted as incombustible products. This result, first, in significant loss of natural resources and, second, in lowering the temperature of combustion process and respectively slacken the technological process, for instant, process of cooking preparation.

This is a particular object of the proposed invention to consequently provide controlled feeding and admixing of the secondary air directly to the base of the flame that enable to produce more efficient and complete combustion process characterized by high-elevated temperature.

More specifically, by the invention, the gas burner, besides the above-mentioned means for introducing a mixture of a primary air and combustion gas under the pressure and the burner head that receiving and issuing the combustible mixture to form a flame, comprises means for providing controlled feeding and admixing of the secondary air in a form of a cap removably and coaxially surrounding the head burner, and including an upper central opening and a side wall with plurality of through lateral openings for exact metering of a secondary air, thereat the lateral openings have a total cross-section grater than total cross-section of the apertures of the burner head.

It is another object of invention to provide gas burners including the means for controlled feeding and admixing of the secondary air that is compatible with wide variety of head burner's design. This is accomplished by having the side wall of a different shape.

It is also an object of the invention to maximally reduce the existence of incombustible products by supplying the cap with a cover formed from heat-resistant gauze.

Yet, another object of invention to provide a method for operating the improved gas burners that allow to save large amount of a such valuable source of natural fuel as gas and increase the efficiency of technological processes utilizing the gas burners by feeding and admixing the secondary air in an exact metered amount directly to a base of a flame.

The foregoing objects and other objects as well as the particular construction of the improved gas burners and the method of operating the gas burners will become more apparent and understandable from the following detail description thereof when read in conjunction with the accompanying drawings.

BRIEF DESCRIPTION OF THE ACCOMPANYING DRAWINGS

DETAILED DESCRIPTION OF THE PREFERRED EMBODIMENT

Figure 1:
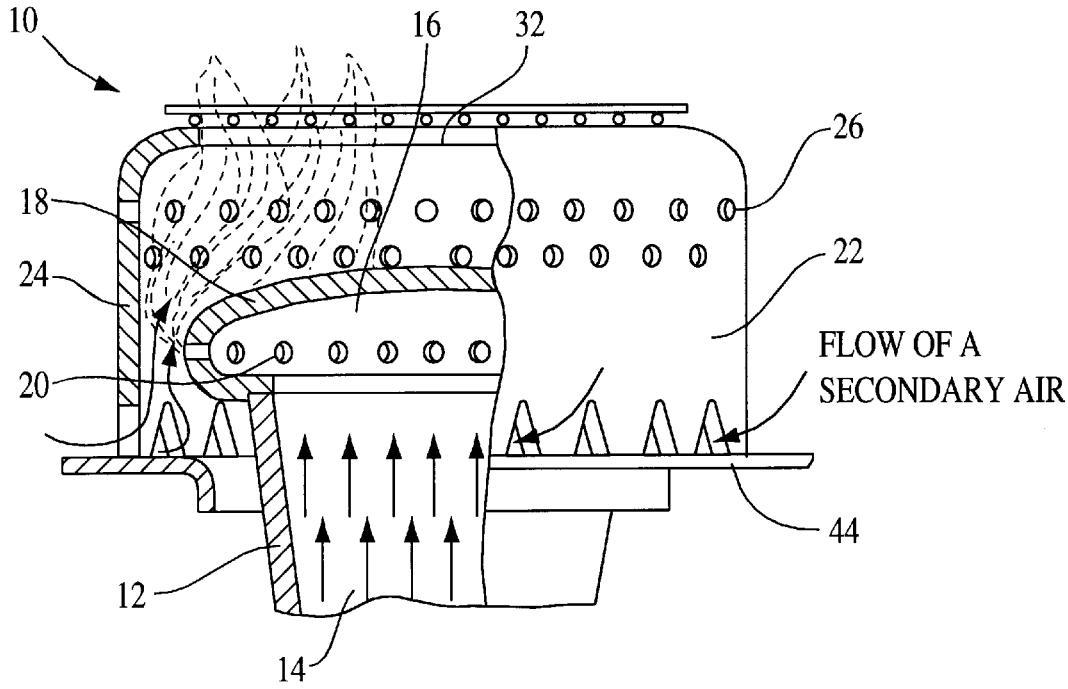
FIGS. 1 shows a sectional frontal view of the gas burner according to the invention with the burner head of the spherical type having the circular through lateral openings.

Turning now to the drawings, FIG. 1 shows a gas burner according to the invention generally denoted by reference numeral 10 that could be employed for the domestic stove with the burner head of the spherical type, or so called classical gas burners.

The burner 10 essentially comprises means for forming and subsequent introducing the mixture of the combustion gas and primary air under the pressure at the predetermined ratio. This means may include diffusor 12 with a bore 14, an injector for supplying gas to an inlet of the venturi (not shown) to compose the mixture with the primary air at a predetermined ratio. The flow of the air-gas mixture directed from the injector through the venturi introduced at a high speed into the bor 14 of diffusor 12 where that speed is converted to the pressure of the particular corresponding value. As a result the combustible air-gas mixture introduced under the preselected pressure into the inlet port (not shown) and then dissipates within the receiving chamber 16 of the burner head 18 wich is positioned adjacent the bore 14.

The burner head 18 provided with lateral apertures 20 intended to issue and consequently uniformly distribute the combustible mixture all around the surface of the burner head and the ignitor, such as a pilot light (not shown). This causes the initiating a flame 28 of a particular concentration.

Figure 7:
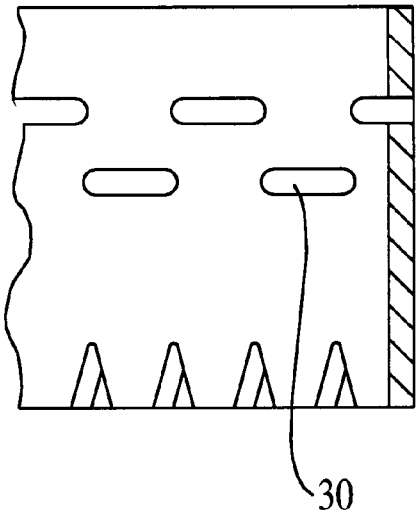
FIG. 7 shows the partial frontal sectional view of the gas burner according to the invention with the gas burner wherein the through lateral openings are represented by longitudinal slots.
Figure 8:
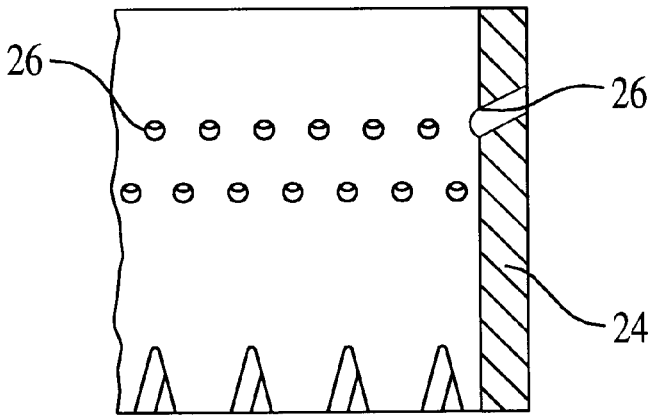
FIG. 8 shows the partial frontal sectional view of the gas burner according to the invention, wherein the through lateral openings have their cental axis angled to the central axis of the cap at an angle different from 0° and 90°.

The gas burner 10 further includes means for providing controlled feeding and subsequent admixture of the secondary air directly to the flame. The means may be in a form of a cap 22 removably and coaxially surrounding the burner head 18. The cap 22 comprises a side wall 24 that includes a plurality of through lateral openings 26 of the predetermined size that enable to supply exact metered amount of the secondary air. The openings may have a circular cross-section. In order to provide the secondary air in amount sufficient for producing the most complete combustion process, the openings 26 have the total cross-section greater than the total cross-section of the apertures 20 of the burner head 18. The central axis of the each of the openings 26 are angled to the central axis of the cap 22, so as to supply the secondary air directly to the base of the flame 28. Thereat, the angle is in the range from 0° to 90°. It should be noted that lateral openings may be configured as a longitudinal slots 30, as depicted on FIG. 7.

The central upper opening 32 is defined by the upper edge of the side wall 24 for escaping of the combustion products.

The cap 22 additionally includes a cover 34 that is formed from a heat-resistant gauze and mounted to the upper edge of the side wall 24 that intends to prevent escaping of products of incomplete combustion the appearance of which might occur during the operation of the gas burner, so that to assure complete combustion process.

Figure 2:
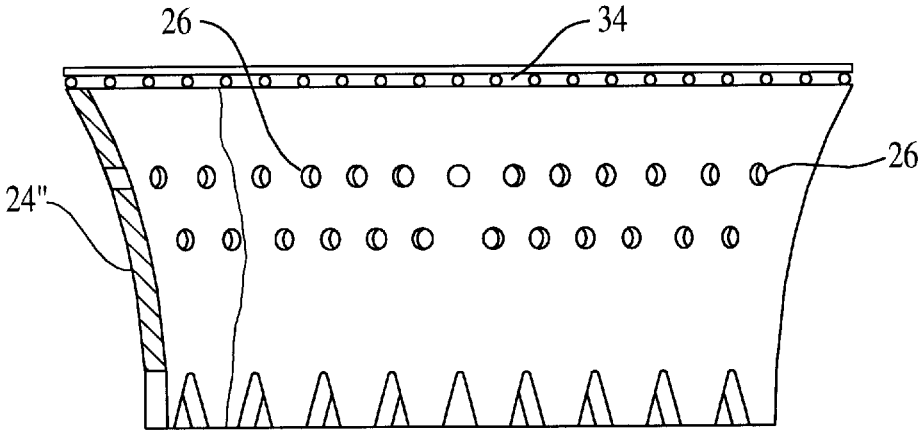
FIGS. 2, 3 shows other embodiments of the gas burner of FIG. 1.
Figure 3:
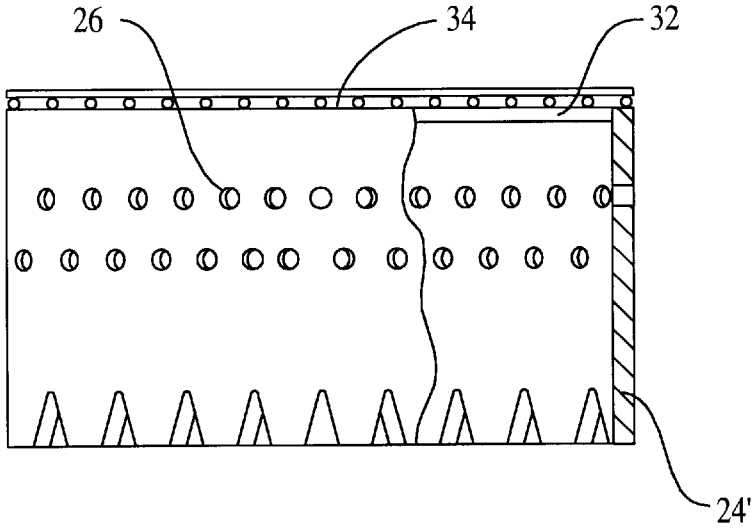

FIGS. 2, 3 show another embodiments of the gas burner that have the cap 22 adapted for enclosing the burner head of the different dimensions and design, regarding in particular to the gas burner of the type having the classical burner head.

Figure 4:
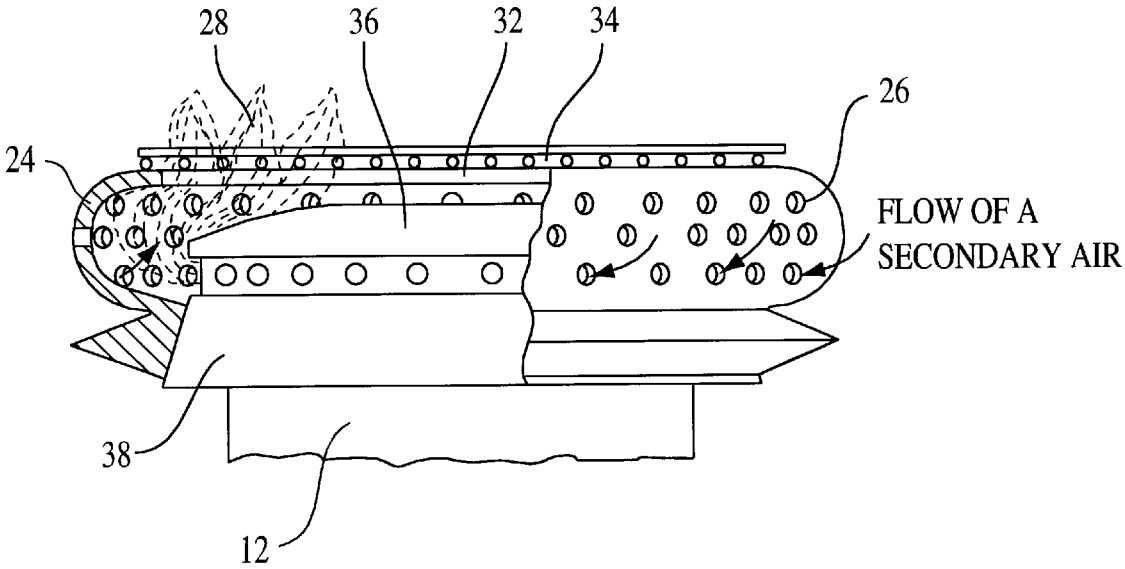
FIG. 4 shows a sectional frontal view of the gas burner according to the invention with the burner head of the flat type.
Figure 5:
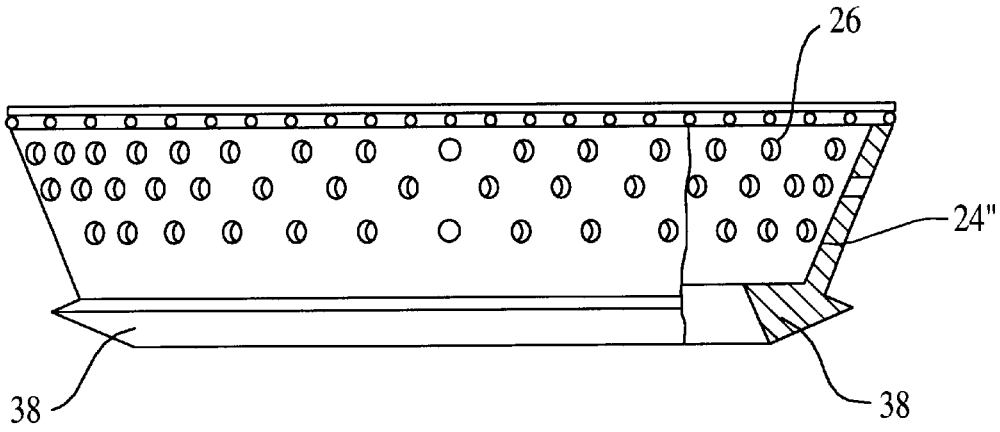
FIGS. 5, 6 shows other embodiments of the gas burner of FIG. 4.
Figure 6:
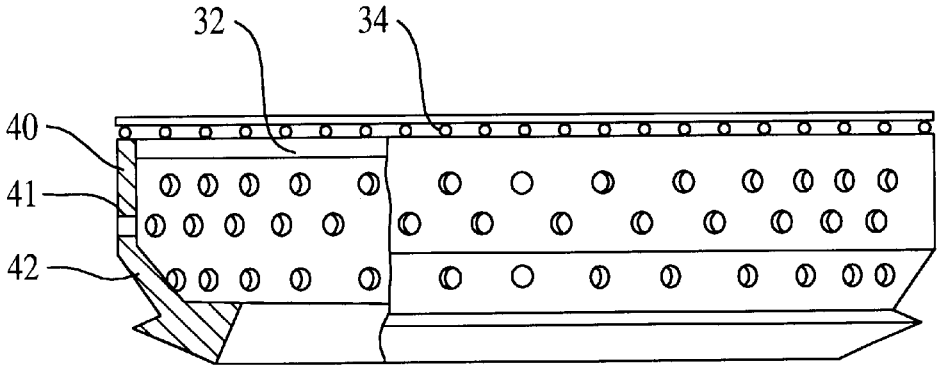

FIGS. 4, 5, 6 show the different embodiments of the gas burner 10 with flat burner head 36 and a skirt 38 flaring downwardly from this head.

As could be noticed from the drawings, the embodiments differentiate from each other mainly by a performance of the side wall 24 as to be of variety of shapes. One of embodiments includes the side wall 24' having a cylindrical shape, as specifically shown on FIG. 2. Another embodiments shown on FIGS. 3, 6 include the side wall 24" having a shape of frustum cone. And embodiment shown on FIG. 5 includes the side wall 40 having a design consisting of an upper cylindrical portion 41 with depending frustum cone base portion 42.

In case when the gas burners include the burner head of a classical type, the cap 22 may be mounted directly to the table 44 of the stove. And, in cases constituted by other embodiments, for example shown at FIG. 4, the cap 22 may be mounted to the skirt 38.

The dimensions of the cap 22 as well as parameters of the through lateral opening 26 are determined upon the particular design and dimensions of the burner head.

During the operation of the gas burner the exact metered amount of the secondary air is supplied through lateral openings 32 of the cap 22 with high concentration at a base of the flame 28. Thus, an additional source of air is provided and mixed with the gas at a high heat capacity created by the flame. As a result the substantially all amount of the presented in combustible mixture gas is exposed to combustion, thereby producing a heat output characterized by high elevated temperature that accelerates the heat exchanging process of the stove and correspondingly increases its coefficient of efficiency. This means, that the efficiency of the technological process applying the improved gas burners, in turn, significantly escalates, as for example the speeding of the cooking time.

Foregoing description of the present invention demonstrates the ability of the invention that could be successfully employed in different type of gas domestic appliances for providing highly efficient and complete combustion process. Although this description was done in connection with the preferred embodiment thereof, it will be appreciated by those skilled in the art that some substitution and or additions may be made without departing from the spirit and scope of the invention as defined in the appended claims.

I claim:

1. An improved gas burner, comprising: a burner head, a receiving chamber located within said burner head, means for forming and subsequent introduction of a combustion mixture of a primary air and gas under pressure into the receiving chamber, said head containing circumferentially positioned lateral apertures for issuing and uniformly distributing said mixture around said burner head to form a flame, and a cap encompassing said burner head for providing controlled feeding and subsequent admixing of the secondary air directly to the base of the flame, said controlled feeding being effected above and below the introductory points of the combustion mixture into the cap, said cap removably and coaxially surrounding said burner head and including an enclosing side wall, an upper central opening for escaping of combustion products and two sets of through lateral openings of a predetermined size disposed on a surface of the enclosing side wall for exact metering of the admixing secondary air, of which one set being situated below introductory points of the combustion mixture into an interior of the cap, and the other set being situated above said introductory points, the lateral openings being dimensioned to have a total cross-section greater than a total cross-section of said apertures of said burner head, each of said lateral openings further having a central axis angled to a central axis of said cap.

2. An improved gas burner according to the claim 1, wherein said cap further includes a cover mounted to the upper edge of said side wall.

3. An improved gas burner according to the claim 2, where in the cover is formed from a heat-resistant gauze.

4. An improved gas burner according to the claim 1, wherein said through lateral openings are longitudinal slots.

5. An improved gas burner according to the claim 1, wherein the through lateral openings are constructed to have a circular cross-section.

6. An improved gas burner according to claim 1, wherein the angle between the central axis of each lateral opening and the central axis of said cap is in range from 0° to 90°.

7. An improved gas burner according to claim 1, wherein said cap is adapted to have the enclosing side wall of a variety of dimensions and shapes selected in correspondence with a particular type of the burner head employed in the gas burner.

8. An improved gas burner according to the claim 7, wherein said side wall has a shape of a frustum cone tapered to its basis.

9. An improved gas burner according to the claim 7, wherein said side wall is of cylindrical shape.

10. An improved gas burner according to claim 9, wherein said side wall has its upper edge curved radially inward.

11. An improved gas burner according to the claim 7, wherein said side wall is configured to include an upper cylindrical portion with depending frusto - conical base portion.

* * * * *